US006737837B1

(12) United States Patent
Halvarsson et al.

(10) Patent No.: US 6,737,837 B1
(45) Date of Patent: May 18, 2004

(54) DEVICE AND A METHOD FOR CONTROL OF POWER FLOW IN A TRANSMISSION LINE

(75) Inventors: Per Halvarsson, Vasteras (SE); Mojtaba Noroozian, Vasteras (SE)

(73) Assignee: ABB AB, Vasteras (SE)

( * ) Notice: Subject to any disclaimer, the term of this patent is extended or adjusted under 35 U.S.C. 154(b) by 57 days.

(21) Appl. No.: 10/303,081

(22) Filed: Nov. 25, 2002

(51) Int. Cl.[7] ..... G05F 5/00
(52) U.S. Cl. ..... 323/205
(58) Field of Search ..... 323/205, 206, 323/207, 208, 209, 210

(56) References Cited

U.S. PATENT DOCUMENTS 4,939,617 A * 7/1990 Hoffman et al. ..... 361/64
4,999,565 A * 3/1991 Nilsson ..... 323/210
5,032,738 A * 7/1991 Vithayathil ..... 307/112
5,309,346 A * 5/1994 Gyugyi ..... 363/54
5,343,139 A * 8/1994 Gyugyi et al. ..... 323/207
5,825,162 A * 10/1998 Kida et al. ..... 323/210

* cited by examiner

*Primary Examiner*—Adolf Berhane
(74) *Attorney, Agent, or Firm*—Dykema Gossett PLLC

(57) ABSTRACT

A device (2) for control of a power flow in a three-phase ac transmission line (L2, La, Lb, Lc) has, for each of its phases (a, b, c), a transformer (12*a*, 12*b*, 12*c*) with a primary winding (121*c*) and a secondary winding (122*c*). The secondary winding is serially connected into the respective phase of the transmission line. A voltage dependent on a controllable part of the voltage between the other two phases of the transmission line is applied to the primary winding of the transformer. The device comprises, for each of the phases of the transmission line, a series circuit with a first (T1*a*, T1*b*, T1*c*) and a second (T2*a*, T2*b*, T2*c*) terminal and a connection point (Ja, Jb, Jc). The series circuit comprises a first reactive impedance element (21*a*, 21*b*, 21*c*) with a fixed reactance connected between the first terminal and the connection point, and a second reactive impedance element (22*a*, 22*b*, 22*c*, 23*a*, 23*b*, 23*c*) with a variable reactance connected between the connection point and the second terminal. One of said terminals is coupled to the respective phase of the transmission line and the other terminal is coupled to a terminal at each of the other two series circuits so that, for all the phases, either the first or the second terminal is coupled to the transmission line. The mentioned primary winding is coupled between the connection points at the other two series circuits.

14 Claims, 5 Drawing Sheets

DEVICE AND A METHOD FOR CONTROL OF POWER FLOW IN A TRANSMISSION LINE

TECHNICAL FIELD

The present invention relates to a device and a method for control of power flow in a three-phase transmission line, whereby an additional voltage is serially applied to this line, for each of its phases, which additional voltage is generated in dependence on a controllable part of the voltage between the other two phases of the transmission line, and use of such a device for control of the distribution of transmitted power between parallel transmission lines and for damping of oscillations in active power between two power networks interconnected by means of a transmission line.

BACKGROUND ART

A transmission line in this context shall mean a three-phase ac line that interconnects two electric power networks and transmits active power between the power networks.

Different kinds of devices for both static and dynamic control of the power flow in such a transmission line are known. The object of the control may be a static distribution of power between power lines or power networks, as well as damping of power oscillations in the transmission line.

One such known device is a so-called phase shifting transformer (PST). The device comprises, for each of the phases of the transmission line, a series transformer, the secondary winding of which is connected into the phase conductor, and a shunt transformer, the primary winding of which is connected between the other two phase conductors. The secondary winding of the shunt transformer is provided with an on-load tap changer and its secondary voltage, which is thus variable, is applied to the primary winding of the series transformer. The additional voltage which arises across the series transformer, and which is thus a series voltage vectorially added to the voltage of the phase conductor, attains, by this connection, a phase position that is displaced by 90° relative to the phase voltage of the phase conductor. By varying the amplitude of the additional voltage by means of the on-load tap changer, the power flow in the transmission line is influenced.

Such a phase-shifting transformer will be further described in the following.

As an alternative to the on-load tap changer, the secondary voltage of the shunt transformer may be applied to converter equipment, suitable for the purpose, for electronic control of the amplitude of the secondary voltage, for example by phase-angle control.

The on-load tap changer constitutes a mechanical component that requires maintenance and is subjected to wear. Further, it is relatively slow, the time for a change of the amplitude of the additional voltage being of the order of magnitude of seconds.

Electronic control of the amplitude of the additional voltage may be made faster but, because of its principle of operation, it injects harmonics in the transmission line.

Another such known device is a so-called universal power flow controller (UPFC). A three-phase transformer is connected in shunt connection to the transmission line and the secondary voltage of the transformer is applied to a first three-phase converter of the type pulse-width-modulated, self-commutated voltage-source converter. A second converter of the same kind is connected, by means of a dc voltage intermediate link with a capacitor, to the first converter and the second converter is connected, via its ac terminals, to series transformers connected to the transmission line. As is known, the output voltage of the second converter allows itself to be controlled both with respect to amplitude and phase angle, and may thus be used for a fast and continuous control of both active and reactive power.

The amount of power electronics is, however, relative extensive and complicated and this type of controller is therefore less attractive. Further, it exhibits sensitivity to short-circuit currents and is inclined to apply harmonic and low-frequency harmonics to the transmission line, as well as harmonics associated with the carrier frequency of the pulse-width modulation.

SUMMARY OF THE INVENTION

The object of the invention is to provide a device and a method of the kind described in the introduction, which, in relation to the prior art, constitute an improvement with respect to the above-mentioned drawbacks.

According to the invention, this is achieved by coupling, for each of the phases of the transmission line, to the respective phase, a series circuit with a first and a second terminal and a connection point, the series circuit comprising a first reactive impedance element with a fixed reactance connected between the first terminal and the connection point, and a second reactive impedance element with controllable reactance connected between the connection point and the second terminal, whereby one of said terminals is coupled to the respective phase in the transmission line and the other terminal is coupled to a terminal at each of the other two series circuits such that, for all the phases, either the first or the second terminal is coupled to the transmission line, that the additional voltage is formed in dependence on the voltage between the connection points at the other two series circuits, and that the control of the power flow is performed by varying the reactance of the second impedance element.

In an advantageous further development of the invention, the second impedance element comprises a series circuit of one inductive and one capacitive reactance element so dimensioned in relation to each other that the phase position of the additional voltage may be varied to lie both before and after the phase position for the voltage of the transmission line in the respective phase, such that the active power flow in the transmission line may be influenced both in an increasing and a decreasing direction.

In another advantageous further development of the invention, the first impedance element comprises a first fixed inductor and the second impedance element comprises a cross-magnetized inductor with a magnetic core, a main winding for alternating current, and a control winding for direct current, the reactance of the second impedance element being varied by controlling a magnetic flux associated with the main winding by orthogonal magnetization of the magnetic flux in dependence on a direct current applied to the control winding.

In still another advantageous further development of the invention, the first reactive impedance element comprises a first fixed inductor, and the second impedance element comprises inductor equipment with a number of mutually series-connected fixed second inductors, each one of these being parallel-connected to a controllable short-circuit device, the reactance of the second impedance element being varied by respectively activating and deactivating the short-circuit devices.

Additional advantageous further developments of the invention will be clear from the following description and the appended claims.

With a device according to the invention, the following advantages are achieved, inter alia.

Shunt inductors already present in the transmission line may be utilized as a component in the device.

No mechanically movable parts, nor any converter equipment with continuous control are required.

The device does not apply any harmonics to the transmission line.

The device may also be utilized as a shunt inductor to absorb reactive power when control of power flow is of secondary interest.

Since a device according to the invention introduces additional impedance in the power network, both by the series transformer in the transmission line and by the equivalent impedance for the fixed and the controllable inductor, respectively, the short-circuit current in the transmission line is generally reduced.

BRIEF DESCRIPTION OF THE DRAWINGS

The invention will be described in greater detail by description of embodiments with reference to the accompanying drawings, wherein.

DESCRIPTION OF THE PREFERRED EMBODIMENTS

Figure 1A:
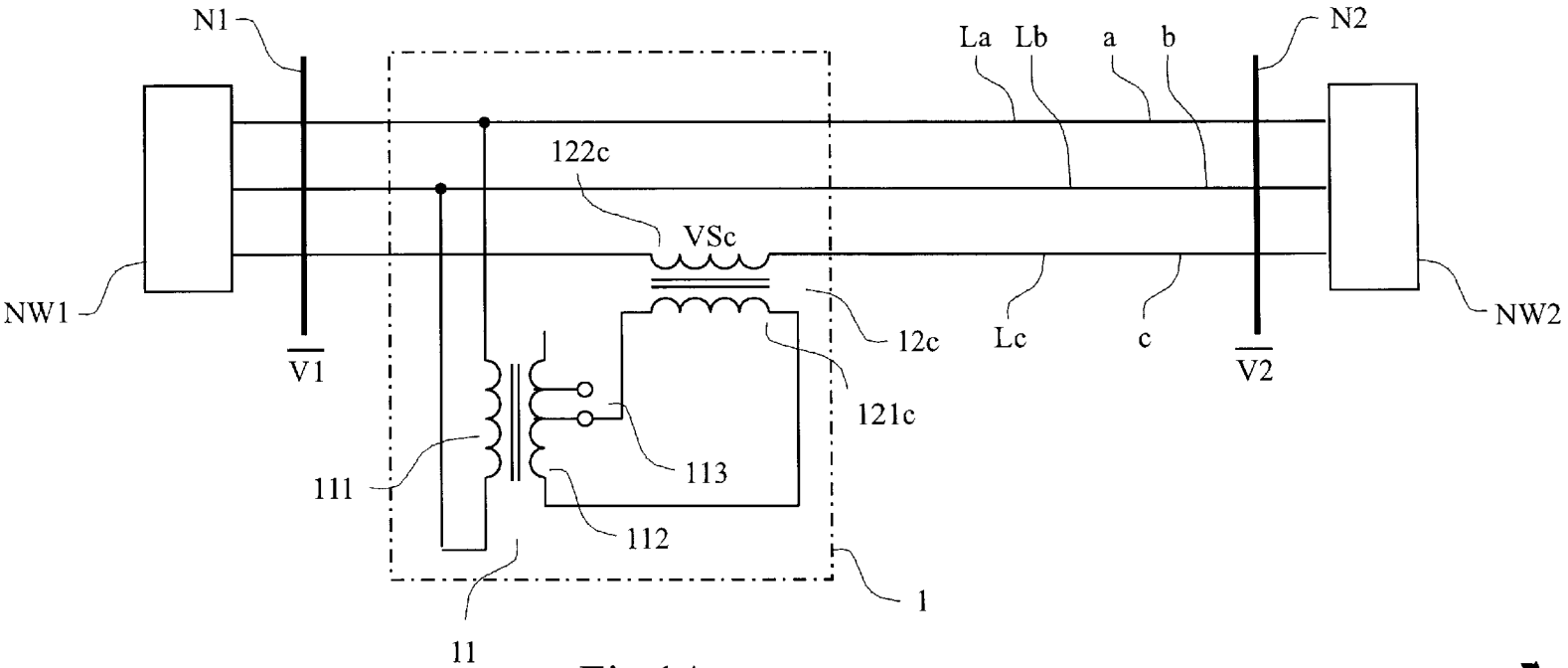
FIG. 1A shows one phase of a phase-shifting transformer according to the prior art.

The following description relates to the method, the device as well as the use of the device.

Throughout the description the same reference numerals are used in the various figures for those parts of the device, and for quantities occurring in the device, which are of the same kind.

FIG. 1A shows a first power network NW1, connected to a second power network NW2 via a three-phase transmission line with the phase conductors La, Lb and Lc. The three phases are designated a, b and c.

A prior art phase-shifting transformer (PST) 1 is connected to the transmission line between two nodes N1 and N2. The voltage of the transmission line at the node N1 is designated $\overline{V1}$ in vector form, the components of the vector consist of the phase voltages Va, Vb and Vc of the node. Analogously, the voltage at the node 2 is designated $\overline{V2}$.

For simplicity, the figure only shows that part of the transformer that belongs to the phase c. The phase-shifting transformer comprises a shunt transformer 11, the primary winding 111 of which is connected between the phase conductors La and Lb in the transmission line. The secondary winding 112 of the shunt transformer is provided with an on-load tap changer 113, only roughly indicated in the figure. A series transformer 12*c* has a secondary winding 122*c* connected into the phase conductor Lc and its primary winding 121*c* is connected to the secondary winding of the shunt transformer between a terminal on the on-load tap changer of the shunt transformer and an end terminal on the secondary winding. The additional voltage VSc occurring across the series transformer attains, by this connection, a phase position that is displaced by 90° relative to the phase voltage Vc. The position of the on-load tap changer may be changed in dependence on a control signal (not shown in the figure), and the voltage applied to the primary winding of the series transformer, and hence the amplitude for the additional voltage VSc, are thus dependent on a controllable part of the voltage between the phases a and b. Although not shown in the figure, it should, of course, be understood that a series transformer of the same kind as the series transformer 12*c* is connected to each of the other two phases of the transmission line and that a voltage is applied thereto in an analogous manner.

Figure 1B:
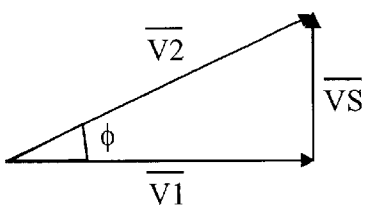
FIG. 1B shows vector diagrams for the voltages of a phase-shifting transformer according to FIG. 1A.

FIG. 1B shows in vector form the relationship between the node voltages $\overline{V1}$, $\overline{V2}$ and $\overline{VS}$, where thus the voltage $\overline{VS}$ has components VSa, VSb and VSc, where VSa and VSb thus represent additional voltages occurring across the series transformers (not shown). The phase-shifting transformer thus achieves a phase shift, in FIG. 1B designated Φ, between the voltages in the nodes 1 and 2. The flow of active power P between the nodes is determined, as is known, besides by the node voltages and the impedance of the transmission line between the nodes, by the factor sinΦ and may thus be influenced by changing the position of the on-load tap changer.

Figure 2:
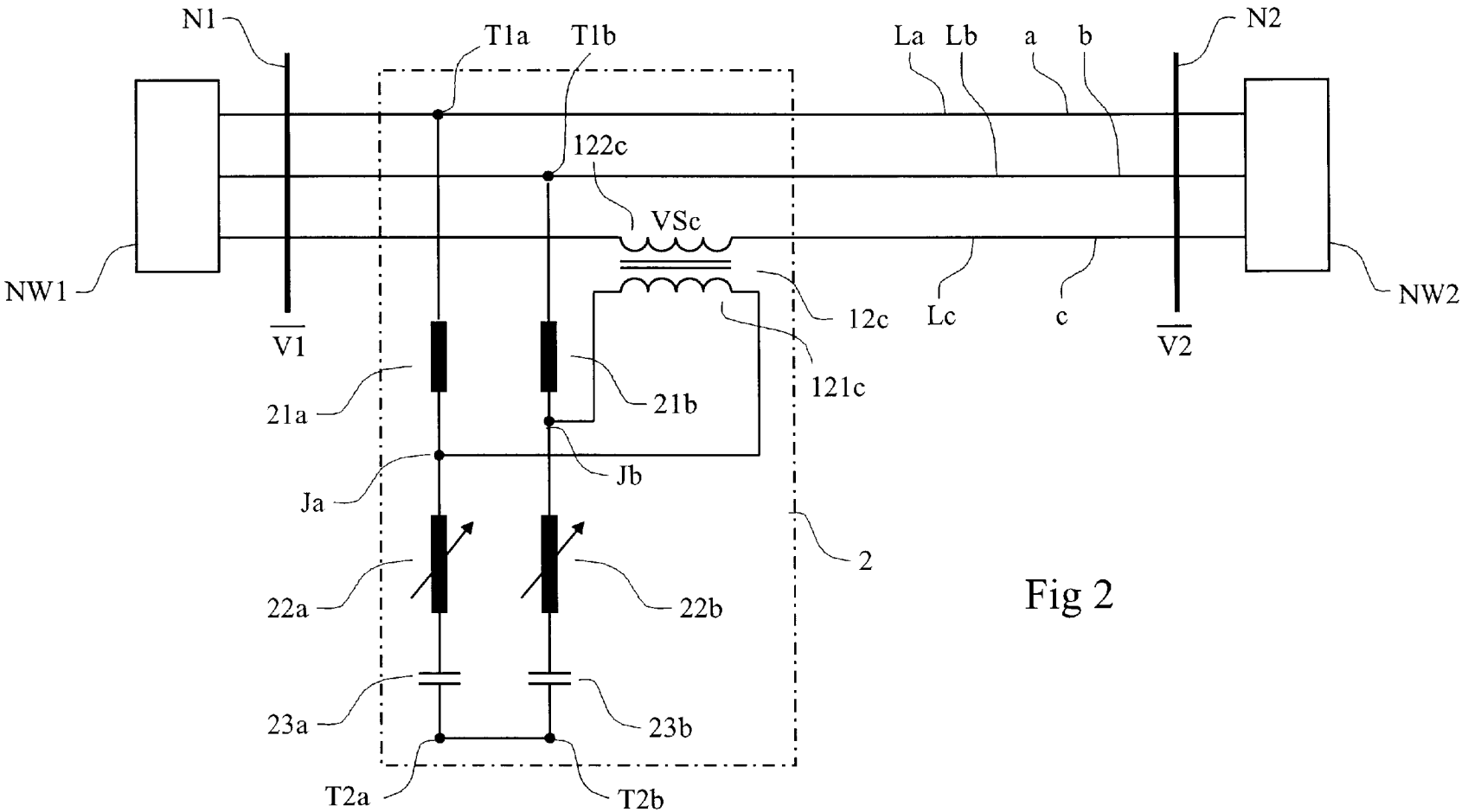
FIG. 2 shows one phase of an embodiment of the device according to the invention.

FIG. 2 shows an embodiment of a device according to the invention. In the same way as for the known device according to FIG. 1A, for the sake of simplicity FIG. 2 only shows that part of the device that belongs to the phase c. Compared with the known device described with reference to FIG. 1A, the shunt transformer with its on-load tap changer have been replaced by other components, which will be described in greater detail below.

A series circuit formed from reactive impedance elements comprises a first reactive impedance element with a fixed reactance in the form of a fixed inductor 21*a* and a second reactive impedance element with a variable reactance in the form of a controllable inductor 22*a* and a capacitor 23*a* connected in series. The first impedance element is connected between a first terminal T1 at the series circuit and a connection point Ja belonging to the series circuit. The second impedance element is connected between the connection point Ja and a second terminal T2*a* at the series circuit. The first terminal T1*a* is coupled to the phase conductor La of the transmission line.

A series circuit of the same kind as that described above comprises a fixed inductor 21*b*, a controllable inductor 22*b*, and a capacitor 23*b*. This series circuit has a first terminal T1*b*, a second terminal T2*b*, and a common connection point Jb. The inductors 21*b*, 22*b*, and the capacitor 23*b* are interconnected and connected to the terminals and the connection point in a manner analogous to that described above. The first terminal T1*b* of the series circuit is coupled to the phase conductor Lb and the two terminals T2*a* and T2*b* are mutually coupled to each other.

As in the device described with reference to FIG. 1A, the series transformer 12*c* is connected with its secondary winding 122*c* into the phase conductor Lc, whereas its primary winding 121*c* is coupled between the connection points Ja and Jb.

It is realized that a device of the above kind achieves a phase shift between the node voltages $\overline{V1}$ and $\overline{V2}$ in a manner similar to that described with reference to FIG. 1A. The flow of active power P between the nodes is thus also determined, in this device, besides by the node voltages and the impedance of the transmission line between the nodes, by the factor sinΦ, which in turn, as is easily realized, is dependent on the voltage between the connection points Ja and Jb.

This voltage, in turn, obviously depends on the relationships between the reactances of the first and second impedance elements, that is, the flow of active power between the nodes N1 and N2 is influenced when the reactance for the second impedance element is varied. The relative influence from the second impedance element increases with increasing transmitted power in the transmission line.

The controllable inductor comprised in the second impedance element achieves a voltage component VSc with a phase position in relation to the phase position of the phase voltage of the transmission line such that the power flow in the transmission line from the node N1 to the node N2 is influenced in a decreasing direction. The capacitor comprised in the second impedance element achieves a voltage component VSc with a phase position in relation to the phase position for the phase voltage of the transmission line such that the power flow in the transmission line from the node N1 to the node N2 is influenced in an increasing direction.

By a suitable dimensioning of the reactances for the controllable inductor and capacitor in relation to each other, the phase position for the additional voltage VSc may be caused to vary to be both before and behind the phase position for the phase voltage V1*c* of the transmission line by variation of the reactance for the controllable inductor. In this way, thus, controllability is obtained in both directions for the active power flow in the transmission line such that the active power flow in the transmission line may be influenced both in an increasing and a decreasing direction.

The controllable inductor comprised in the second impedance element may, in an advantageous embodiment of the invention, be constituted by an inductor controllable by means of so-called cross magnetization. Such an inductor has a magnetic core with a main winding for alternating current and is, in addition thereto, provided with a control winding for direct current. By varying a direct current supplied to the control winding, the magnetic flux associated with the main winding is influenced by orthogonal magnetization of the magnetic core. Such a cross-magnetized inductor is known, for example, from U.S. Pat. No. 4,393,157.

Figures 3A, 3B:
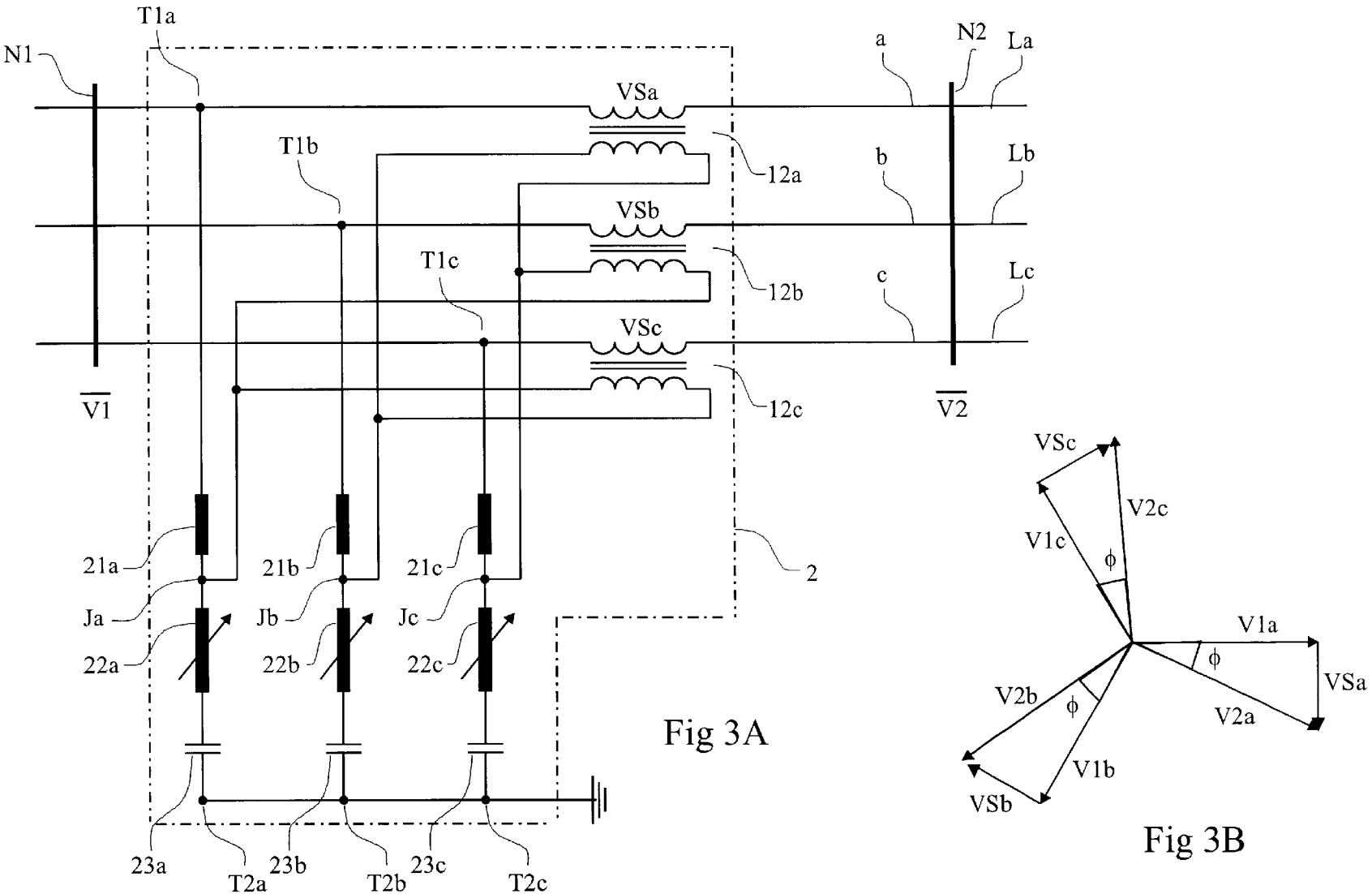
FIG. 3A shows three phases of an embodiment of a device according to the invention.
FIG. 3B shows vector diagrams for the voltages of an embodiment of the invention according to FIG. 3A.

FIG. 3A shows the embodiment according to FIG. 2 with all of the three phases illustrated. A series transformer 12*a* has a secondary winding connected into the phase conductor La, and a series transformer 12*b* has a secondary winding connected into the phase conductor Lb. An additional voltage VSa arises across the series transformer 12*a*, and an additional voltage VSb arises across the series transformer 12*b*.

A series circuit of the same kind as those described with reference to FIG. 2 comprises a fixed inductor 21*c*, a controllable inductor 22*c*, and a capacitor 23*c*. This series circuit has a first terminal T1*c*, a second terminal T2*c*, and a common connection point Jc. The inductors 21*c* and 22*c* and the capacitor 23*c* are connected to each other and to the terminals and the connection point in a manner analogous to that described above. The first terminal T1*c* of the series circuit is coupled to the phase conductor Lc and the terminals T2*a*, T2*b* and T2*c* are mutually coupled to each other and shown in the figure as coupled to ground potential.

The series transformers 12*a* and 12*b* are connected with their secondary windings into the respective phase conductors La and L. The primary winding of the series transformer 12*a* is coupled between the connection points Jb and Jc, whereas the primary winding of the series transformer 12*b* is coupled between the connection points Ja and Jc.

FIG. 3B shows in vector form the relationship between the node voltages $\overline{V1}$, $\overline{V2}$ and the additional voltage $\overline{VS}$, where thus the voltage $\overline{V1}$ has the components V1*a*, V1*b* and V1*c*, the voltage $\overline{V2}$ has the components V2*a*, V2*b* and V2*c*. $\overline{VS}$ has the components VSa, VSb and VSc.

Figure 4A:
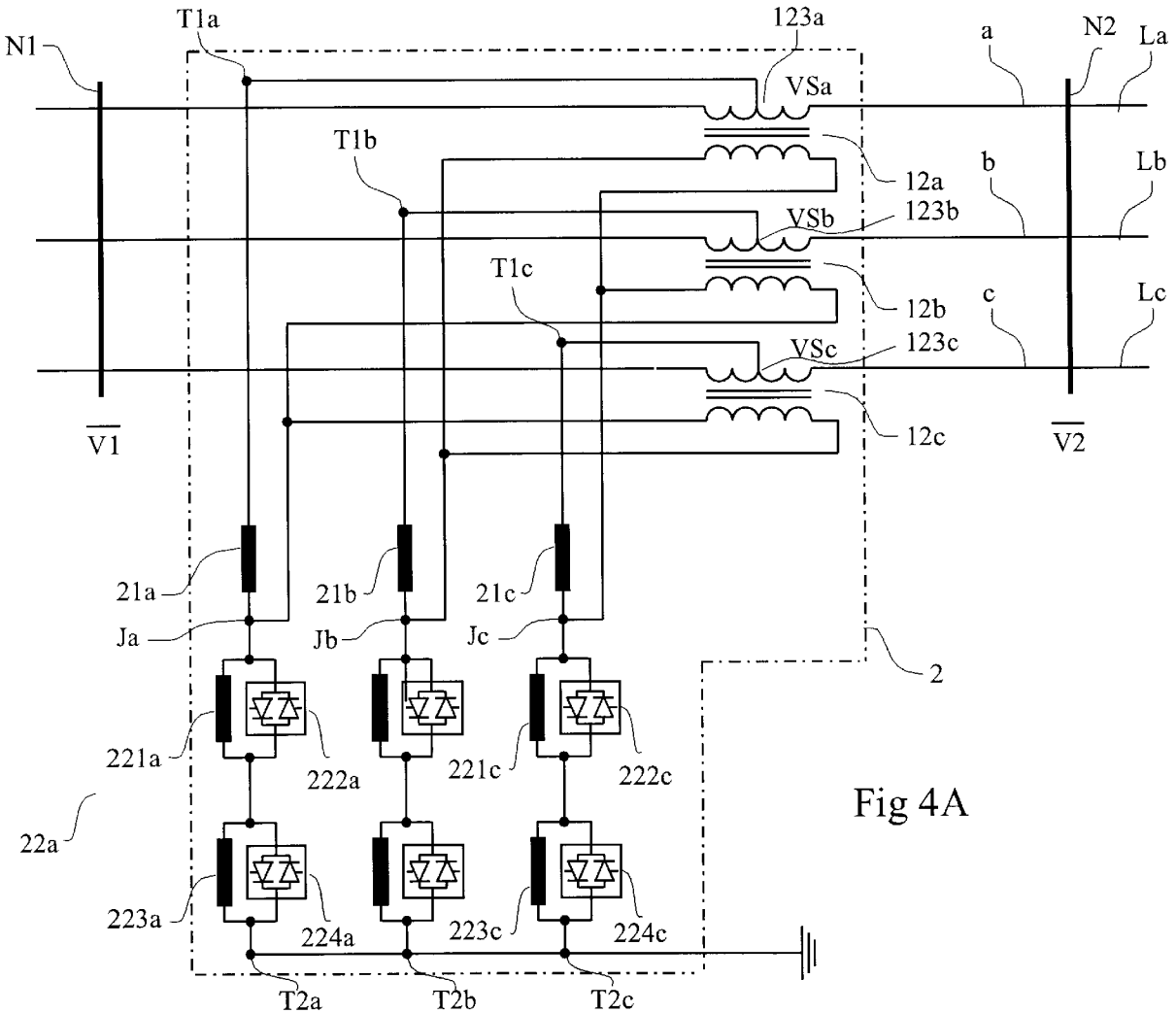
FIG. 4A shows three phases of a further embodiment of a device according to the invention.

FIG. 4A shows a further embodiment of a device according to the invention. Contrary to the embodiment described in connection with FIG. 3A, the respective first terminals T1*a*, T1*b* and T1*c* of the series circuits, in this embodiment, are connected to centre taps 123*a*, 123*b* and 123*c* on the secondary windings of the respective series transformer. Further, for the phase a, the second impedance element 22*a* comprises inductor equipment with a number of mutually series-connected fixed inductors, which for reasons of space are only shown as two inductors 221*a* and 223*a* in the figure. Each one of the fixed inductors 221*a* and 223*a* may be by-passed by means of a controllable short-circuit device, in the figure illustrated as a thyristor switch 222*a* and 224*a*, respectively, which may be influenced by a control signal (not shown). The respective second impedance elements for the phases b and c are designed in an analogous manner and comprise, for the phase b, fixed inductors 221*b* and 223*b* (the designations being omitted in the figure to render it more readily readable) with thyristor switches 222*b* and 224, respectively, and, for the phase c, fixed inductors 221*c* and 223*c* with thyristor switches 222*c* and 224*c*, respectively.

For reasons of space, only two series-connected fixed inductors per phase are shown in the figure, but the number may, of course, be advantageously increased to increase the possibilities of control of the reactance of the second impedance element. Preferably, the inductance values for the inductors 221*a*, 223*a*, . . . are chosen according to a geometrical scale to further increase the possibilities of variation of the reactance of the second impedance element.

Figure 4B:
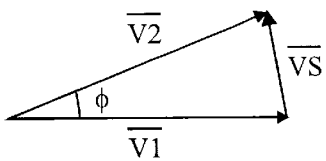
FIG. 4B shows three vector diagrams for the voltages of an embodiment of the invention according to FIG. 4A.

FIG. 4B shows in vector form the relationship between the node voltages $\overline{V1}$, $\overline{V2}$ and the additional voltage $\overline{VS}$ in this embodiment of the invention. By connecting the respective first terminals T1*a*, T1*b* and T1*c* of the series circuits to the centre taps 123*a*, 123*b* and 123*c* on the secondary windings of the series transformers, the advantage is achieved, contrary to the embodiment described with reference to FIG. 3, that the node voltage $\overline{V2}$ will have the same amplitude as the node voltage $\overline{V1}$.

Figure 5:
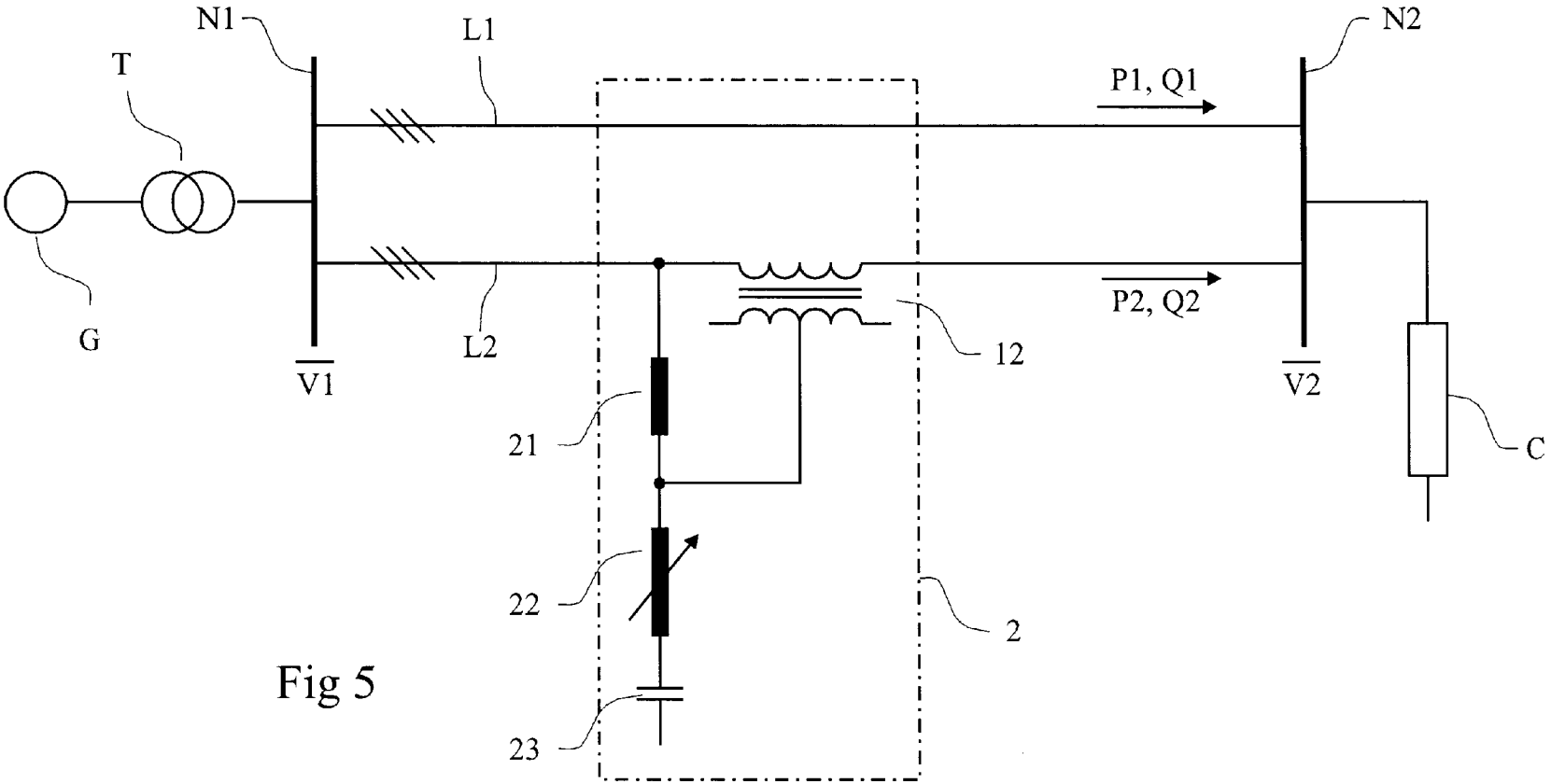
FIG. 5 shows a use of a device according to the invention.

FIG. 5 shows a use of a device according to the invention. Two three-phase transmission lines L1 and L2 connect nodes N1 and N2. Node N1 is supplied, via a transformer T, with power from a generator G. To node N2, a load C is connected. Of the power supplied to node N1, one part P1 is distributed on the transmission line L1 and one part P2 is distributed on the transmission line L2. The nominal voltage of the transmission lines is 400 kV.

A device 2 according to the invention is coupled to the transmission line L2. The device is illustrated in a simplified single-line diagram, but it is to be understood that it is designed, for example, in the manner described with reference to FIG. 3A. The first reactive impedance element with a fixed reactance thus comprises an inductor 21, and the second reactive impedance element comprises an inductor 22 with a variable reactance and, in series connection therewith, a fixed capacitor 23.

In a practical embodiment, the load C consumes an active power of 600 MW and a reactive power of 150 MVAr, that is, P1+P2=600MW.

The series transformer 12 has a rated power of 135 MVA, a transformation ratio of 60/60 kV, and a short-circuit reactance of 10%.

The fixed inductor 21 has a rated power of 120 MVAr at 400 kV, corresponding to a reactance of 1 333 ohms. The reactor 22 has a reactance that is variable in the interval of 30–150 ohms whereas the capacitor 23 has a fixed reactance of −60 ohms. The reactance of the second reactive impedance element may thus in this case be varied from −30 ohms to +90 ohms.

Studies have shown that the power P2 can be controlled from 150 MW to 450 MW when the reactance of the second impedance element is varied from −30 ohm to +90 ohms. The voltage across the second reactive impedance element thereby varies within the interval of 46–56 kV whereas the current through the impedance element varies within the interval 1.14–0.25 kA.

The control of the reactance of the second impedance element occurs in some manner known to the person skilled in the art by supplying a deviation between a sensed value of active power in the transmission line and a reference value thereof to a controller, whereby a reference value for desired reactance is formed in dependence on an output signal from the controller. In the event that the second impedance element consists of a cross-magnetized inductor, this reference value may be in the form of a suitably adapted direct current supplied to the control winding of the inductor. In the event that the second impedance element comprises fixed inductors provided with short-circuit devices, as described with reference to FIG. 4A, these short-circuit devices may be activated, for example by choosing in a table of the relationship between reactance and activated short-circuit device(s).

When damping power oscillations, a signal representing oscillations in the active power in the transmission line is formed in some manner known to the person skilled in the art, and this signal, after suitable signal processing, is summed to the output signal from the above-mentioned controller.

The invention is not limited to the embodiments shown, but, of course, the person skilled in the art may modify it in a plurality of ways within the scope of the invention as defined in the claims. Thus, of course, the embodiment described with reference to FIG. 4A may be equipped with capacitors in a manner corresponding to the capacitors 23*a*, 23*b* and 23*c* in connection with the embodiment described with reference to FIG. 3A.

The capacitors may also be individually divided into a number of series-connected units, in which each unit is equipped with a controllable short-circuit device of a kind similar to that described with reference to FIG. 4A As mentioned above, in the embodiment described with reference to FIG. 4A, the second impedance element 22*a*, 22*b* and 22*c*, respectively, may preferably be made with a larger number of mutually series-connected fixed inductors than what is shown in FIG. 4A.

The fixed reactance of the first impedance element may advantageously consist of a shunt inductor present in the transmission line.

What is claimed is:

1. A device for control of power flow in a three-phase ac transmission line, comprising for each of its phases a transformer with a primary winding and a secondary winding, the secondary winding being intended for serial connection into the respective phase of the transmission line, and the primary winding of the transformer being intended to be supplied with a voltage that is dependent on a controllable part of the voltage between the other two phases of the transmission line, wherein the device comprises, for each of the phases of the transmission line, a series circuit with a first and a second terminal and a connection point, the series circuit comprising a first reactive impedance element with a fixed reactance connected between the first terminal and the connection point, and a second reactive impedance element with a variable reactance connected between the connection point and the second terminal, wherein one of said terminals is coupled to the respective phase in the transmission line and the other of the terminals is coupled to a terminal at each of the other two series circuits, such that, for all the phases, either the first or the second terminal is coupled to the transmission line, and the primary winding is coupled between the connection points at the other two series circuits.

2. A device according to claim 1, wherein the second impedance element comprises a series circuit of an inductive and a capacitive reactance element.

3. A device according to claim 1, wherein the first impedance element comprises a first fixed inductor, and that the second impedance element comprises a cross-magnetized inductor with a magnetic core, a main winding for alternating current, and a control winding for direct current, the control winding for control of a magnetic flux associated with the main winding by orthogonal magnetization of the magnetic core.

4. A device according to claim 1, wherein the first impedance element comprises a first fixed inductor, and that the second impedance element comprises inductor equipment with a number of mutually series-connected fixed second inductors, each of these being connected in parallel with a controllable short-circuit device.

5. A device according to claim 1 wherein the transmission line has at least one conductor per phase, and those of the terminals of the series circuits coupled to the respective phase of the transmission line are connected to said conductor(s) in the transmission line.

6. A device according to claim 1, wherein the secondary windings of the transformers are provided with centre taps, and the terminals of the series circuits which are coupled to the respective phase of the transmission line are connected to said centre taps.

7. Use of a device according to claim 1 for control of the distribution of power transmitted between parallel transmission lines by coupling the device in one of the transmission lines.

8. Use of a device according to claim 1 for damping oscillations in active power between two power networks interconnected by means of a transmission line by coupling the device to the transmission line.

9. A method for control of power flow in a three-phase transmission line, wherein said transmission line, for each of its phases, is serially supplied with an additional voltage, said additional voltage being generated in dependence on a controllable part of the voltage between the other two phases of the transmission line, comprising the steps of for each one of the phases of the transmission line, there is connected, to the respective phase, a series circuit with a first and a second terminal and a connection point, the series circuit comprising a first reactive impedance element with a fixed reactance connected between the first terminal and the connection point, and a second reactive impedance element with a controllable reactance connected between the connection point and the second terminal, whereby one of said terminals is coupled to the respective phase of the transmission line and the other terminal is coupled to a terminal at each one the two other two series circuits such that, for all the phases, either the first or the second terminal is coupled to the transmission line, for the respective phase the additional voltage is formed in dependence on the voltage between the connection points at the series circuits that are coupled to the other two phases, and the control of the power flow occurs by varying the reactances of the second impedance elements.

10. A method according to claim 9, wherein the second impedance element comprises a series circuit of an inductive and a capacitive reactance element, wherein the inductive and capacitive elements are dimensioned in relation to each other such that the phase position for the additional voltage may be varied to lie both before and behind the phase position for the voltage of the transmission line in the respective phase such that the active power flow in the transmission line may be influenced both in an increasing and in a decreasing direction.

11. A method according to claim 9, wherein the first impedance element comprises a first fixed inductor, and that the second impedance element comprises a cross-magnetized inductor with a magnetic core, a main winding for alternating current, and a control winding for direct current, wherein the reactance of the second impedance element is varied by controlling a magnetic flux associated with the main winding by orthogonal magnetization of the magnetic core in dependence on a direct current supplied to the control winding.

12. A method according to claim 9, wherein the first reactive impedance element comprises a first fixed inductor, and that the second impedance element comprises inductor equipment with a number of mutually series-connected fixed second inductors, each one of these being connected in parallel with a controllable short-circuit device wherein the reactance of the second impedance element is varied by respectively activating and deactivating the short-circuit devices.

13. A method according to claim 9, wherein the transmission line has at least one conductor per phase, wherein those of the terminals of the series circuits that are coupled to the respective phase in the transmission line are connected to said conductors in the transmission line.

14. A method according to claim 9, wherein the additional voltage is serially applied to each phase in the transmission line by means of a secondary winding of a transformer, said secondary winding being provided with centre taps, wherein those of the terminals of the series circuits that are coupled to the respective phase in the transmission line are connected to said centre taps.

* * * * *